US009663313B2

(12) United States Patent
Sano et al.

(10) Patent No.: US 9,663,313 B2
(45) Date of Patent: May 30, 2017

(54) SHEET CONVEYER

(71) Applicant: BROTHER KOGYO KABUSHIKI KAISHA, Nagoya-shi, Aichi-ken (JP)

(72) Inventors: Iwane Sano, Obu (JP); Keisuke Wakakusa, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/865,365

(22) Filed: Sep. 25, 2015

(65) Prior Publication Data

US 2016/0090253 A1 Mar. 31, 2016

(30) Foreign Application Priority Data

Sep. 25, 2014 (JP) ..... 2014-194783

(51) Int. Cl.

| | |
|---|---|
| ***B65H 5/26*** | (2006.01) |
| ***B65H 3/44*** | (2006.01) |
| ***B65H 29/58*** | (2006.01) |
| ***B65H 1/04*** | (2006.01) |
| ***B65H 3/06*** | (2006.01) |

(Continued)

(52) U.S. Cl.

CPC ..... *B65H 5/26* (2013.01); *B65H 1/04* (2013.01); *B65H 3/0684* (2013.01); *B65H 3/44* (2013.01); *B65H 3/68* (2013.01); *B65H 5/36* (2013.01); *B65H 5/38* (2013.01); *B65H 29/58* (2013.01); *B65H 2402/46* (2013.01); *B65H 2404/6111* (2013.01); *B65H 2405/324* (2013.01); *B65H 2701/192* (2013.01)

(58) Field of Classification Search

CPC ... B65H 5/26; B65H 5/36; B65H 5/38; B65H 3/44; B65H 3/66; B65H 3/68

See application file for complete search history.

(56) References Cited

U.S. PATENT DOCUMENTS 7,515,520 B2 * 4/2009 Kotaka ..... B41J 11/0095 369/100
8,353,512 B2 * 1/2013 Masuda ..... B65H 5/26 271/186

(Continued)

FOREIGN PATENT DOCUMENTS

JP 04064540 A * 2/1992
JP 2005314069 A * 11/2005
JP 2008-74063 A 4/2008

*Primary Examiner* — Luis A Gonzalez
(74) *Attorney, Agent, or Firm* — Merchant & Gould P.C.

(57) ABSTRACT

A sheet conveyer has a casing defined with first and second conveying passages and respectively having first and second curved passages. The first and second curved passages curve in opposite directions. A flap rotatably provided to a second guide member constituting a curved outside part of the first curved passage. When the flap is at a first position, the flap blocks passage from a part of the first conveying passage to the connection position, while the second conveying passage is opened to the connection position. When the flap is at the second position, the first conveying passage is opened toward the connection position and a part of the second conveying passage is blocked with respect to the connection position. A guide surface constituting an upper surface of the first curved passage is closer to the third guide member than a guide roller when the flap is at the second position.

11 Claims, 10 Drawing Sheets

(51) Int. Cl.

| | |
|---|---|
| ***B65H 3/68*** | (2006.01) |
| ***B65H 5/38*** | (2006.01) |
| ***B65H 5/36*** | (2006.01) |

(56) References Cited

U.S. PATENT DOCUMENTS

| | | | | |
|---|---|---|---|---|
| 2008/0074458 | A1 | 3/2008 | Niioka et al. | |
| 2010/0301549 | A1* | 12/2010 | Moriyama | B65H 3/44<br>271/264 |
| 2013/0082437 | A1* | 4/2013 | Asada | B41J 13/103<br>271/109 |
| 2013/0134016 | A1* | 5/2013 | Uchino | B65H 5/062<br>198/722 |

* cited by examiner

UP
FRONT
REAR
DOWN
7
8
70
33
18
43
42
65 (65B)
44
11
32
66 (66A)
90
67
80
65 (65A)
36
34
37
31
54
60
61

UP
FRONT
REAR
DOWN
7
8
70
33
18
43
42
65 (65B)
44
11
32
66 (66A)
90
67
80
65 (65A)
36
34
37
31
54
60
61

UP
DOWN 8
FRONT
REAR
7
70
33
18
43
42
65 (65B)
44
65 (65A)
11
66 (66A)
67
90
80
32
36
34
38
40
31
37
65 (65B)

SHEET CONVEYER

This application claims priority under 35 U.S.C. §119 from Japanese Patent Application No. 2014-194783 filed on Sep. 25, 2014. The entire subject matter of the application is incorporated herein by reference.

BACKGROUND

Technical Field

The present disclosures relate to a sheet conveyer having a first conveying passage and a second conveying passage.

Related Art

A conventional sheet conveyer for a printer or the like typically employs a structure in which printing sheets are conveyed from one of multiple sheet trays to a conveying roller pair through conveying passages respectively extending from the multiple sheet trays. Then the printing sheets are conveyed to a printing unit by the conveying roller pair, and images are printed on the printing sheet. In such a structure, for example, one conveying passage may be extended from one of the sheet trays and have a U-shaped cross section, while another conveying passage may be extended from another sheet tray and have a linear cross section or curvature having a reversed curve in comparison with the U-shaped cross section of the one conveying passage. Such conveying passages are connected to each other at an upstream side, in the sheet conveying direction, with respect to the conveying roller pair (hereinafter, the position where the two conveying passages are connected will be referred to as a connecting position). In such a configuration according to the conventional art, a roller conveyer is further provided between the connecting position and the conveying roller pair so that the printing sheets are smoothly conveyed from the plurality of sheet trays.

SUMMARY

When the printing sheet is conveyed in a warped condition, the leading end of the printing sheet may contact the roller conveyer and may obstacles the smooth conveying of the printing sheet.

In consideration of the above, aspects of the disclosures provide an improved sheet conveyer which has at least two sheet conveying passages connected inside the sheet conveyer, while the printing sheets can be conveyed smoothly in each of the at least two conveying passages.

According to aspects of the disclosures, there is provided a sheet conveyer, which has a casing in which a first conveying passage and a second conveying passage are defined, the first conveying passage extending from a first tray and having a first curved passage which is curved in a particular direction, the second conveying passage extending from a second tray and having a second curved passage, which curves in a direction opposite to the first curved passage, and connected to the first conveying passage at a connection position, a conveying roller configured to convey a sheet and arranged in the first conveying passage at a position opposite to the first tray with respect to the connection position, a first guide member arranged at the connection position and constituting a curved outside part of the first curved passage and a curved inside part of the second curved passage, a second guide member constituting a curved outside part of the first curved passage, in the first conveying passage, on a first tray side with respect to the first guide member, a third guide member constituting a curved inside part of the first curved passage, a guide roller provided to the first guide member and protruded toward a position close to the connection position, and a flap rotatably provided to the second guide member. The flap is maintained at a first position in a neutral state, the flap blocks passage from at least a part of the first conveying passage to the connection position and the second conveying passage is opened to the connection position when the flap is located at the first position. Further, the flap moves to a second position as the flap contacts the sheet conveyed through the first conveying passage, the first conveying passage being opened toward the connection position and at least a part of the second conveying passage is blocked with respect to the connection position, and a guide surface constituting an upper surface of the first curved passage is located at a position closer to the third guide member than the guide roller does when the flap is located at the second position.

BRIEF DESCRIPTION OF THE ACCOMPANYING DRAWINGS

DETAILED DESCRIPTION OF THE EMBODIMENT

Hereinafter, referring to the accompanying drawings, an MFP (multi-function peripheral) 10 according to an illustrative embodiment of the disclosures will be described. It is noted that the embodiment described below is merely an illustrative embodiment and various modification could be made without departing from the gist of the disclosures.

It is noted that, in the following description, up and down directions are defined based on a state where the MFP 10 is placed for use (i.e., the state shown in FIG. 1), and front and rear directions are defined such that a surface of the MFP 10 on which an opening 13 is formed is a front side of the MFP 10, and the opposite side is defined as a rear side of the MFP 10. Further, right and left directions are defined such that, when the MFP 10 is viewed from the front side, a right-hand side of the MFP 10 is defined as a right side of the MFP 10, while a left-hand side of the MFP 10 is defined as a left side of the MFP 10.

<Entire Structure of MFP>

Figure 1:
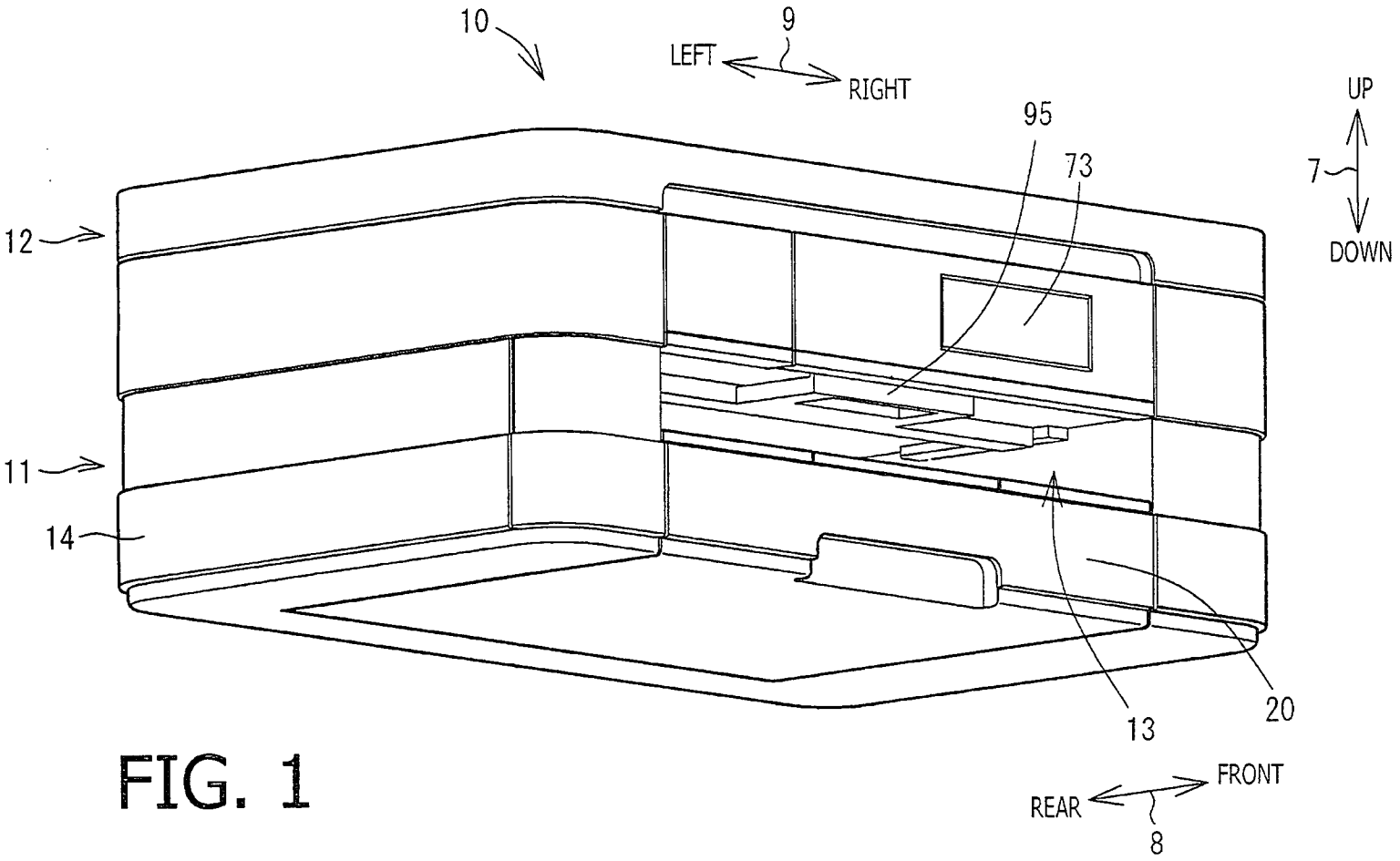
FIG. 1 is a perspective view showing an appearance of an MFP (multi-function peripheral) according to an illustrative embodiment of the disclosures.

As shown in FIG. 1, the MFP 10 has a substantially cuboid shape. An upper part of the MFP 10 is configured as a scanner unit 12. According to the illustrative embodiment, the scanner unit 12 is a flatbed scanner. Since the configuration of the flatbed scanner is well-known, detailed description thereof will be omitted for brevity.

A lower part of the MFP 10 is configured as a printer unit 11. According to the illustrative embodiment, the printer unit 11 is configured to print images on printing sheets 6 or the like in accordance with an inkjet printing method. It is noted that, another type of printer such as an electrophotographic printer configured to form images on the recording sheets 6 in accordance with an electrophotographic image formation method may be used instead of the inkjet printing method.

According to the illustrative embodiment, the MFP 10 has various functions such as a facsimile function in addition to the printer function described above.

According to the illustrative embodiment, the MFP 10 also has a function of forming images on a recording medium such as a CD-ROM (compact disc ROM) or a DVD-ROM (digital versatile disc ROM) which has generally thicker than a printing sheet 6.

According to the illustrative embodiment, the recording medium has a plate-like member, and is conveyed in a linear passage 65B and a label print passage 67 with being supported by a medium tray 71 (see FIG. 8) which is configured to support the plate-like medium. In this case, the medium tray 71 is an example of a conveyed medium set forth in claims. It is noted that the printer unit 11 may be configured such that the recording medium itself is conveyed in the linear passage 65B and the label print passage 67. In this case, the recording medium is an example of the recording medium set forth in the claims, and also is an example of the conveyed medium set forth in the claims.

The printer unit 11 has a casing 14 which is formed with an opening 13 on its front surface. The casing 14 is an outer cover defining an inner space in which components of the printer unit 11 are accommodated. At the opening 13, a sheet feed tray 20 configured to support the various sizes of printing sheets 6 and a discharged sheet tray 21 are provided so as to be inserted/removed along the front-rear direction.

Figure 2:
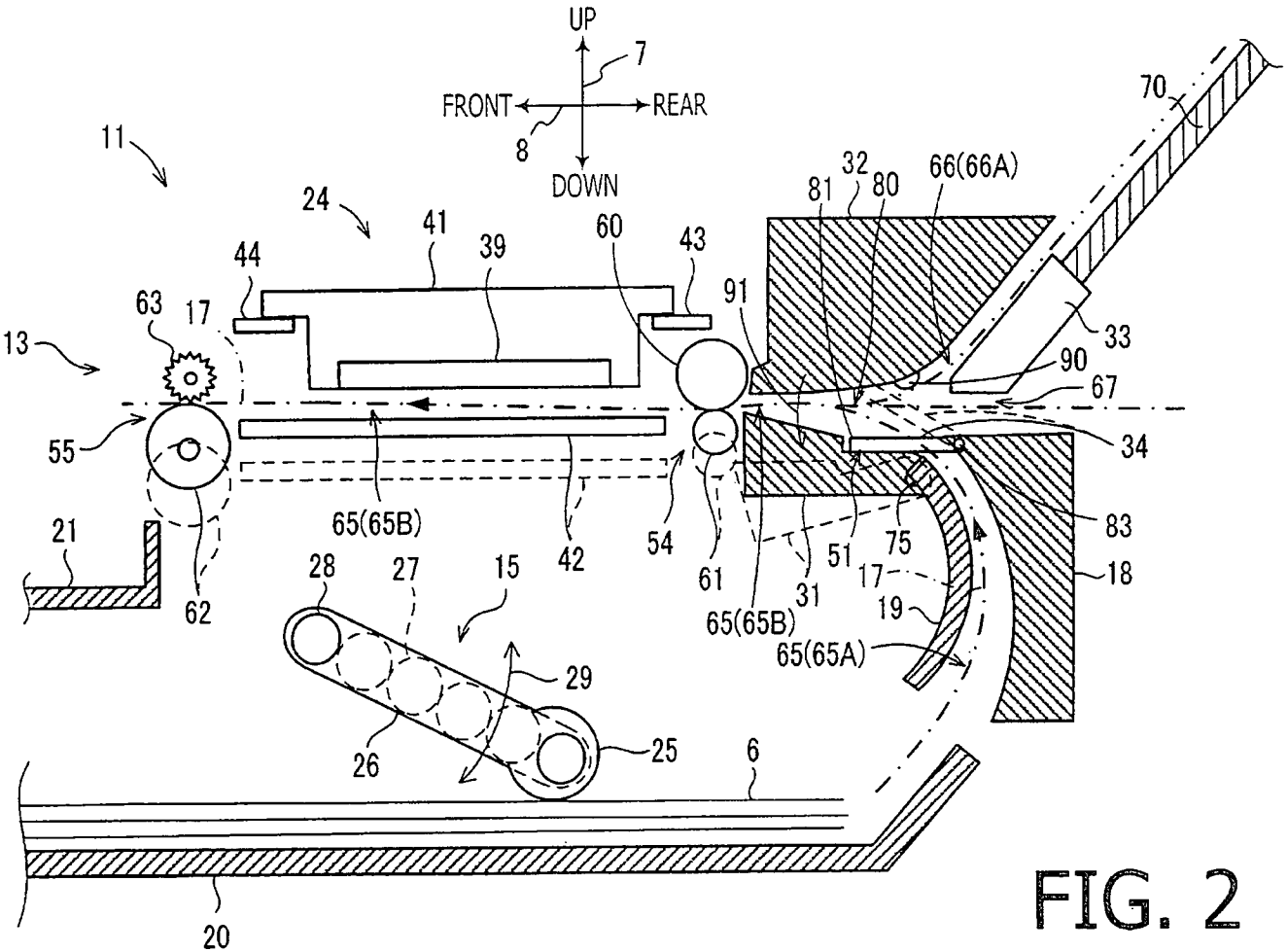
FIG. 2 is a cross-sectional side view schematically showing an inner structure of a printer unit of the MFP according to the illustrative embodiment of the disclosures.

As shown in FIG. 2, the printer unit 11 has a feeding unit 15 configured to feed the printing sheets 6 from the sheet feed tray 20, a recording unit 24 configured to record images on the printing sheets 6, a first conveying roller pair 54 and a second conveying roller pair 55 configured to covey the printing sheets 6 and the medium tray 71, a conveying passage 65, the label print passage 67, and a bypass passage 66. Specifically, inside the casing 14, the feeding unit 15, the recording unit 24, the first conveying roller pair 54 and the second conveying roller pair 55 are arranged. Further, the conveying passage 65, the bypass passage 66, and the label print passage 67 are formed inside the casing 14. It is noted that the conveying passage 65 is an example of a first conveying passage, the bypass passage 66 is an example of a second conveying passage, and the label print passage 67 is an example of a third conveying passage set forth in the claims.

<Sheet Feed Tray 20>

The sheet feed tray 20 shown in FIGS. 1 and 2 has a box-like shape with its upper surface is opened. Above the sheet feed tray 20, the discharged sheet tray 21 is arranged. The sheet feed tray 20 is configured to accommodate and support, on its supporting surface, various sizes of printing sheets 6 in stacked manner. The casing 14 is configured to accommodate the sheet feed tray 20 in its inner space communicating with the opening 13. The sheet feed tray 20 is configured to be inserted and/or withdrawn with respect to the casing 14 through the opening 13.

<Feeding Unit 15>

As shown in FIG. 2, the feeding unit 15 has a sheet feed roller 25, a sheet feed arm 26 and a driving force transmission mechanism 27. The feeding unit 15 is arranged above the sheet feed tray 20, and below the recording unit 24. The sheet feed roller 25 is rotatably supported at a free end part of the sheet feed arm 26. The sheet feed arm 26 is configured to be rotatable, about a shaft 28 provided at a proximal end part of the arm 27, in a direction indicated by arrow 29. In accordance with rotation of the sheet feed arm 26, the sheet feed roller 25 moves toward or away from the supporting surface of the sheet feed tray 20. Accordingly, when the sheet feed tray 20 accommodating the printing sheets 6 is attached to the casing 14, the sheet feed roller 25 is capable of contacting the printing sheets 6 accommodated in the sheet feed tray 20.

A driving force of a motor (not shown) is transmitted to the sheet feed roller 25 through the driving force transmission mechanism 27. The driving force transmission mechanism 27 has a gear train including multiple gears engaged subsequently to transmit the rotational force of the motor to a shaft of the sheet feed roller 25 so that the sheet feed roller 25 rotates in accordance with the driving force applied by the motor. As the sheet feed roller 25 rotates with contacting the uppermost one of the printing sheets 6 accommodated on the supporting surface of the sheet feed tray 20, the uppermost printing sheet 6 is fed to the conveying passage 65.

<Conveying Passage 65>

The conveying passage 65 is a passage through which the printing sheet 6 fed from the sheet feed tray 20 passes. As shown in FIG. 2, the conveying passage 65 defined in the inner space of the casing 14 has a curved passage 65A and the linear passage 65B. It is noted that the curved passage 65A is an example of a first curved passage set forth in the claims.

The curved passage 65A extends upward from a rear end of the sheet feed tray 20 in a curved manner. In other words, the curved passage 65A is extended from the sheet feed tray 20, and is curved such that the rear side and front side of the casing 14 are respectively regarded as outside and inside of the curvature of the curved passage 65A. It is noted that the curved direction shown in FIG. 2 is an example of a particular direction set forth in the claims. The curved passages 65A extends from the rear end of the sheet feed tray 20 to a connection position 80 which is a position where the conveying passage 65 and the bypass passage 66 are connected.

The curved passage 65A is defined by an outer guide member 18 and an inner guide member 19 which face each other, and a first upper guide member 32 and a lower guide member 31 which face each other. It is noted that a space through which the printing sheet 6 can pass through is defined between the outer guide member 18 and the inner guide member 19, and between the first upper guide member 32 and the lower guide member 31. It is noted that the outer guide member 18 and the first upper guide member 32 are example of second and first guide member set forth in the claims. Further, the inner guide member 19 and the lower guide member 31 are examples of a third guide member set forth in the claims.

Figures 5A, 5B:
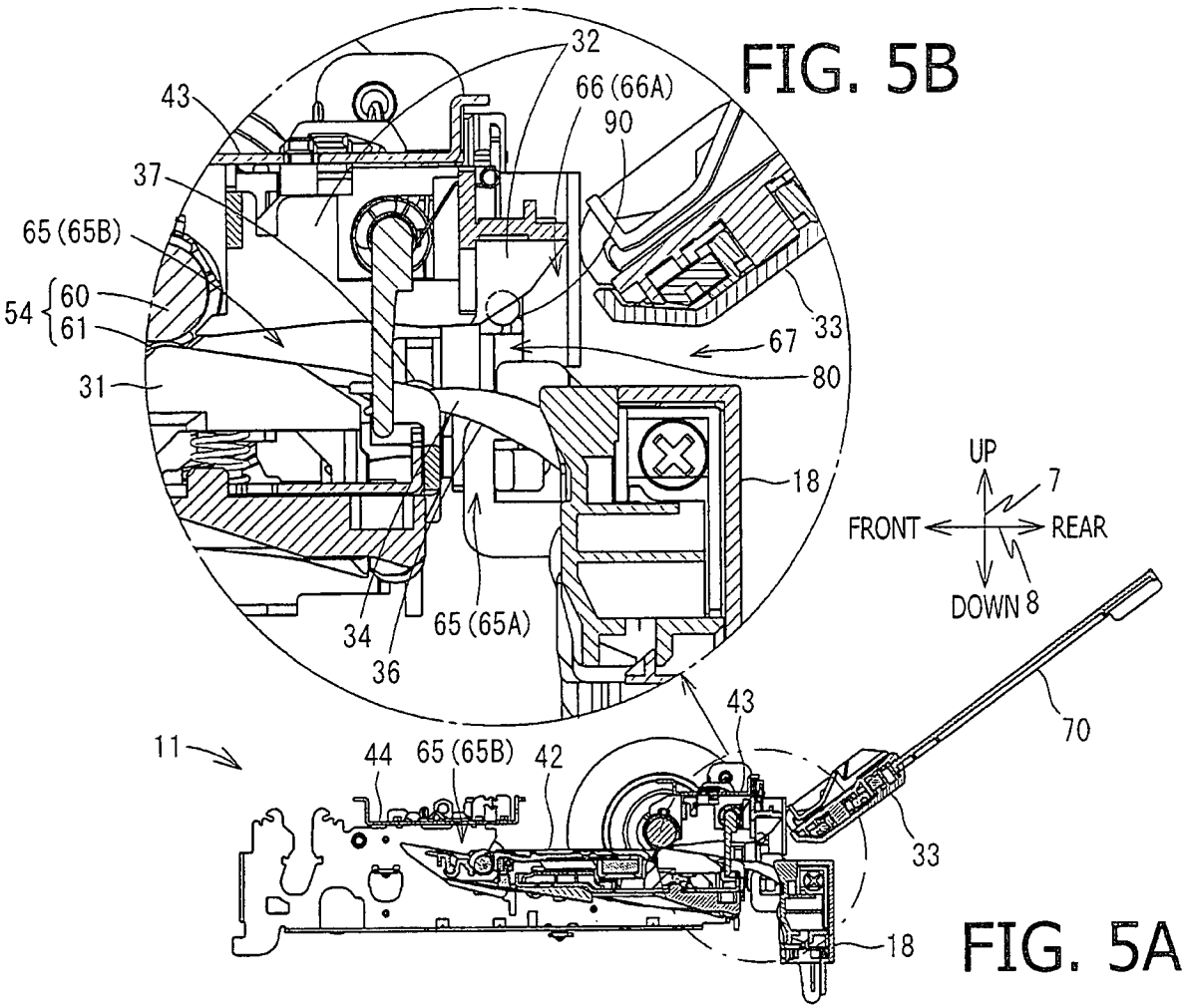
FIG. 5A is a cross-sectional view taken along line A-A in FIG. 4 and showing a state where a flap is located at a first position.
FIG. 5B is an enlarged view of a part of FIG. 5A encircled by dotted line.
Figures 6A, 6B:
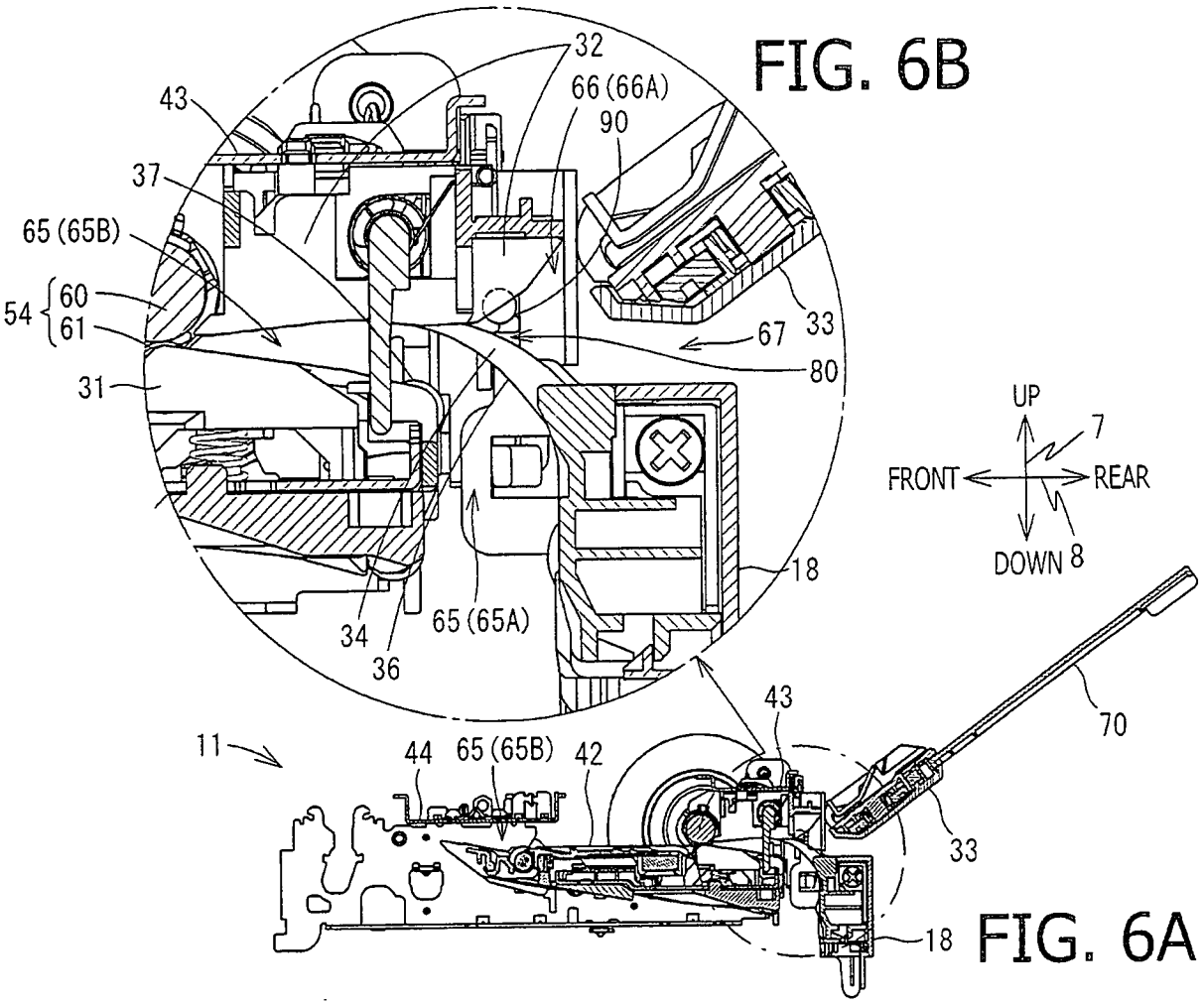
FIG. 6A is a cross-sectional view taken along line A-A in FIG. 4 and showing a state where a flap is located at a second position.
FIG. 6B is an enlarged view of a part of FIG. 6A encircled by dotted line.

The lower guide member 31 rotatably supports a roller conveyer 37 (see FIGS. 5B and 6B). A circumferential surface of the roller conveyer 37 is protruded in the curved passage 65A. With this structure, the printing sheet 6 conveyed through the curved passage 65A contacts the circumferential surface of the roller conveyer 37 and conveyed smoothly thereby. It is noted that the roller conveyer 37 may be rotatably supported by the inner guide member 19 instead of the lower guide member 31.

The linear passage 65B is connected to the curved passage 65A at the connection position 80. The linear passage 65B linearly extends frontward from the connection position 80 toward a first conveying roller 60, which will be described later, and reaches the discharged sheet tray 21. Since the linear passage 65B is substantially linearly, the medium tray 71 can pass therethrough without being bend.

Figure 4:
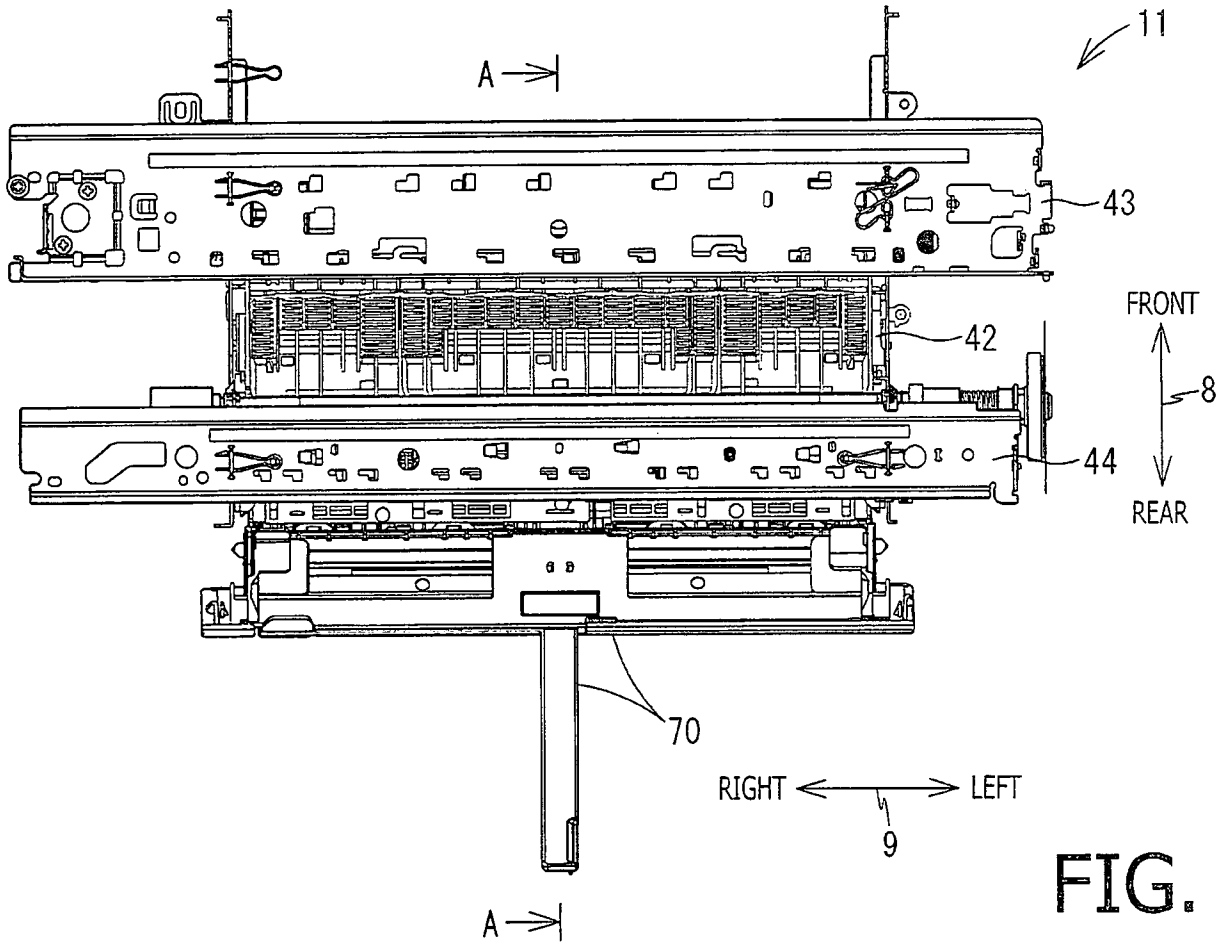
FIG. 4 is a plan view showing a platen and components therearound of the printer unit of the MFP according to the illustrative embodiment of the disclosures.

The linear passage 65B is defined by the recording unit 24 and the first upper guide member 32, and a platen 42 (see FIG. 4) and the lower guide member 31 which are arranged to face the recording unit 24 and the first upper guide member 32 with the space, through which the printing sheet 6 and the medium tray 71 can pass through, being arranged therebetween.

The printing sheet 6 conveyed along the conveying passage 65 by the sheet feed roller 25 proceeds upward along the curved passage 65A with making a U-turn, and then conveyed frontward along the linear passage 65B. That is, the printing sheet 6 is conveyed in a conveying direction 17 which is indicted by a dotted line with an arrow in FIG. 2.

The lower guide member 31 is arranged below the connection position 80. The lower guide member 31 defines a curved inside part which is a part of the curved passage 65A on a downstream side, in the conveying direction 17, with respect to the inner guide member 19, and a lower part of the linear passage 65B on an upstream side, in the conveying direction 17, with respect to the platen 42.

The first upper guide member 32 is arranged above the connection position 80. The first upper guide member 32 defines a curved outside part which is a part of the curved passage 65A on the downstream side, in the conveying direction 17, with respect to the outer guide member 18, and an upper side part of the linear passage 65B on the upstream side, in the conveying direction 17, with respect to the recording unit 24. Further, the first upper guide member 32 constitutes a curved inside part of the bypass passage 66.

The outer guide member 18 defines a curved outside part which is a part of the curved passage 65A on the upstream side, in the conveying direction 17, with respect to the first upper guide member 32. In other words, the outer guide member 18 constitutes the curved outside part of the curved passage 65A on the sheet feed tray 20 side with respect to the first upper guide member 32.

The inner guide member 19 defines the curved inner part of the curved passage 65A on the upstream side, in the conveying direction 17, with respect to the lower guide member 31. In other words, the inner guide member 19 constitutes the curved inner part of the curved passage 65A on the sheet feed tray 20 side with respect to the lower guide member 31.

<First Conveying Roller Pair 54 & Second Conveying Roller Pair>

As shown in FIG. 2, the first conveying roller 54 is provided at an upstream side, in the conveying direction 17, of the linear passage 65B with respect to the recording unit 24. The conveying roller pair 54 is arranged on the downstream side, in the conveying direction, with respect to the connection position 80. In other words, the first conveying roller pair 54 is arranged at a position, along the conveying passage 65, opposite to sheet feed tray 20 with respect to the connection position 80. The first conveying roller pair 54 has a first driving roller 60 and a pinch roller 61 which are configured to contact each other. It is noted that the first conveying roller 60 is an example of a conveying roller set forth in the claims.

In the linear passage 65B, at a position on the downstream side, in the conveying direction 17, with respect to the recording unit 24, a second conveying roller pair 55 is provided. The second conveying roller pair 55 has a second conveying roller 62 and a spur roller 63 which are configured to contact each other.

The first conveying roller 60 and the second conveying roller 62 rotate as the rotating force of a motor (not shown) is applied thereto. When the first conveying roller 60 rotates, the printing sheet 6 nipped by the first conveying roller pair 54 is conveyed. When the second conveying roller 60 rotates, the printing sheet 6 nipped by the second conveying roller pair 55 is conveyed.

<Recording Unit 24>

As shown in FIG. 2, the recording unit 24 is arranged, along the linear passage 65B, between the first roller pair 54 and the second roller pair 55. That is, the recording unit 24 is arranged, along the linear passage 65B, at a position opposite to the sheet feed tray 20 with respect to the first conveying roller 60.

The recording unit 24 has a carriage 41 and a recording head 39. The carriage 41 is supported by guide rails 43 and 44 (see FIGS. 3 and 4), which are arranged above the platen 42, so that the carriage 41 is reciprocally movable in the right-left direction 9. The guide rail 44 is provided with a well-known belt mechanism. Further, the carriage 41 is connected to an endless belt of the belt mechanism, and reciprocally moves in the right-left direction 9 along the guide rails 43 and 44 in accordance with the movement of the endless belt.

The recording head 39 is mounted on the carriage 41. On an under surface of the recording head 39, multiple nozzles (not shown) are formed. Ink is supplied from ink cartridges (not shown) to the recording head 39, and the recording head 39 ejects minute ink drops through the multiple nozzles selectively. Specifically, when the carriage 41 is moving in the right-left direction 9, the ink drops are ejected from the multiple nozzles toward the printing sheet 6 conveyed in the linear passage 65B or the recoding medium supported by the medium tray 71. As the ejected ink drops adhere on the printing sheet 6 on the platen 42 or the recording medium on the medium tray 71, thereby an image being formed on the printing sheet 6 or the recording medium.

<Roller Pairs 54 and 55, Platen 42 and Lower Guide Member 31>

As shown in FIG. 2, the pinch roller 61 and the second conveying roller 62, which are downside rollers of the first conveying roller pair 54 and the second conveying roller pair 55, and the platen 42 are configured to be movable in the up-down direction 7. Further, the lower guide member 31 is rotatable with respect to the casing 14 about a shaft 75 provided on a rear side.

The pinch roller 61 and the second conveying roller 62 are configured to be movable between contact positions (indicated by solid lines in FIG. 2), where the pinch roller 61 and the second conveying roller 62 contact the first conveying roller 60 and the spur roller 63 which are upside rollers, respectively, and spaced positions (indicated by broken lines in FIG. 2), where the pinch roller 61 and the second conveying roller 62 are spaced from the first conveying roller 60 and the spur roller 63, respectively.

It is noted that the up-down movement of the pinch roller 61 and the second conveying roller 62 is realized by a conventional configuration. For example, according to the illustrative embodiment, a lever part 95 (see FIG. 1) provided in the inner space communicating with the opening 13 is connected to a supporting member (not shown) that supports the pinch roller 61 and the second conveying roller 62. In association with a user's operation to move up the lever part 95, the supporting member moves in the up-down direction 7. In accordance with the movement of the supporting member in the up-down direction 7, the pinch roller 61 and the second conveying roller 62 move between the contact positions and the spaced positions, respectively. It is noted that the movement of the pinch roller 61 and the second conveying roller 62 may be realized by another configuration. For example, the pinch roller 61 and the second conveying roller 62 may move as a driving force is applied by a motor (not shown).

When the pinch roller 61 and the second conveying roller 62 are located at the contact positions, the first conveying roller pair 54 and the second conveying roller pair 55 can nip the printing sheet 6 between the rollers constituting respective roller pairs. When the pinch roller 61 and the second conveying roller 62 are located at the spaced positions, the first conveying roller pair 54 and the second conveying roller pair 55 can nip the medium tray 71 between the rollers constituting respective roller pairs.

When the first conveying roller 60 and the second conveying roller 62 rotate in a state where the first conveying roller pair 54 and the second conveying roller pair 55 nips the printing sheet 6 or the medium tray 71, the printing sheet 6 or the medium tray 71 is conveyed along the linear passage 65B or a label print passage 67, which will be described later, respectively.

The platen 42 is configured to be movable between an upside position which is indicated by a solid line in FIG. 2, and a downside position which is indicated by a broken line. When the platen 42 is located at the upside position, a distance, in the up-down direction 7, between the printing sheet 6 supported by the platen 42 and the recording head 39 is appropriate for printing images on the printing sheet 6. When the platen 42 is located at the downside position, the platen 42 is located on a lower position than the upside position, and is located on a down side with respect to the medium tray 71 conveyed through the linear passage 65B.

The lower guide member 31 is configured to be rotatable between a first rotation position which is indicated by a solid line in FIG. 2, and a second rotation position which is indicated by a broken line in FIG. 2. The first rotation position is a position of the lower guide member 31 when the printing sheet 6 is guided in the conveying passage 65. The second rotation position is a position of the lower guide member 31 when the medium tray 71 is guided in the linear passage 65B. It is noted that a movable end when the lower guide member 31 is located at the second rotation position is lower than the movable end of the same when the lower guide member 31 is located at the first rotation position.

The rotation of the lower guide member 31 is realized by a well-known configuration. For example, the lower guide member 31 may be maintained to stay at the first rotation position as being supported by the supporting member connected to the lever part 95, and rotate to the second rotation position as the support by the supporting member is released. Further, the lower guide member 31 at the second rotation position may move from the second rotation position to the first rotation position as moved up by the supporting member which moves in association with the movement of the lever part 95. It is noted that the lower guide member 31 may be configured to move not by rotation but another way. For example, the lower guide member 31 may be configured to slidably move in the up-down direction 7.

<Concave Parts of Lower Guide Member 31>

As shown in FIG. 2, the lower guide member 31 has multiple concave parts 51. The multiple concave parts 51 are arranged in the right-left direction 9 at certain intervals. It is note that positions of the concave parts 51 in the right-left direction 9 correspond to rotatable ends of multiple flaps 34 which will be described later, respectively.

<Label Print Passage 67>

As shown in FIG. 2, the label print passage 67 is defined, inside the casing 14, to extend rearward from the connection position 80. That is, the label print passage 67 extends linearly, from the connection position 80, in a direction opposite to the linear passage 65B. Accordingly, the label print passage 67 and the linear passage 65B constitute substantially a single passage extending substantially along the front-rear direction 8. With this configuration, the label print passage 67 can allow the medium tray 71 to pass therethrough, together with the linear passage 65B, without causing the medium tray 71 to be bent.

The label print passage 67 is defined by an upper surface of an outer guide member 18 and an under surface of the second upper guide member 33, which surfaces face each other with a clearance allowing the medium tray 71 to pass through therebetween.

<Bypass Passage 66 and Bypass Tray 70>

As shown in FIG. 2, a bypass passage 66, which extends from an upper rear portion with respect to the connection position 80 toward the conveying passage 65, is defined inside the casing 14. The bypass passage 65 extends from a bypass tray 70 (described later) to curve such that outside and inside of the curvature are downside and upside, respectively, as indicated by a two-dotted line in FIG. 2. The bypass passage 66 has, as shown in FIG. 2, a curved passage 66A which curves oppositely with respect to the conveying passage 65 (indicted by the dotted line in FIG. 2). It is noted that the bypass tray 70 is an example of a second tray set forth in the claims. Further, the curved passage 66A is an example of a second curved passage set forth in the claims.

The bypass passage 65 is connected to the conveying passage 65 at the connection position 80. The bypass passage 66 is arranged on upper side with respect to both the conveying passage 65 and the label print passage 67. According to the illustrative embodiment, the bypass passage 66 is defined by an under surface of the first upper guide member 32 and an upper surface of the second upper guide member 33, which surfaces face each other with a clearance through which the printing sheet 6 can pass through being arranged therebetween.

A bypass tray 70 is arranged on a rear surface side of the MFP 10 and on an upper side with respect to the outer guide member 18. The bypass tray 70 is configured to support the printing sheet 6 independent from the sheet feed tray 20. The printing sheet 6 supported by the bypass tray 70 is conveyed by the first conveying roller pair 54. Specifically, the printing sheet 6 is inserted into the casing 14 along the bypass passage 66 when the printing sheet 6 is supported by the bypass tray 70. At that time, the leading end portion of the printing sheet 6 is guided by a guide roller 90 and a flap 34 (which will be described later). Then, the printing sheet 6 is supported by the bypass tray 70 with its leading end portion being nipped by the first conveying roller pair 54. In that state, when the first conveying roller 60 rotates, the printing sheet 6 supported by the bypass tray 70 is conveyed through the linear passage 65B by the first conveying roller pair 54.

It is noted that a roller may be provided to face the bypass tray 70 and contact the printing sheet 6 supported by the bypass tray 70. In such a case, the printing sheet 6 supported by the bypass tray 70 may be conveyed through the linear passage 65B as the roller rotates. Thus, in such a case, it is unnecessary that the leading end portion of the printing sheet 6 is nipped by the first conveying roller pair 54 when the printing sheet 6 is supported on the bypass tray 70.

<Guide Roller 90>

Figure 3:
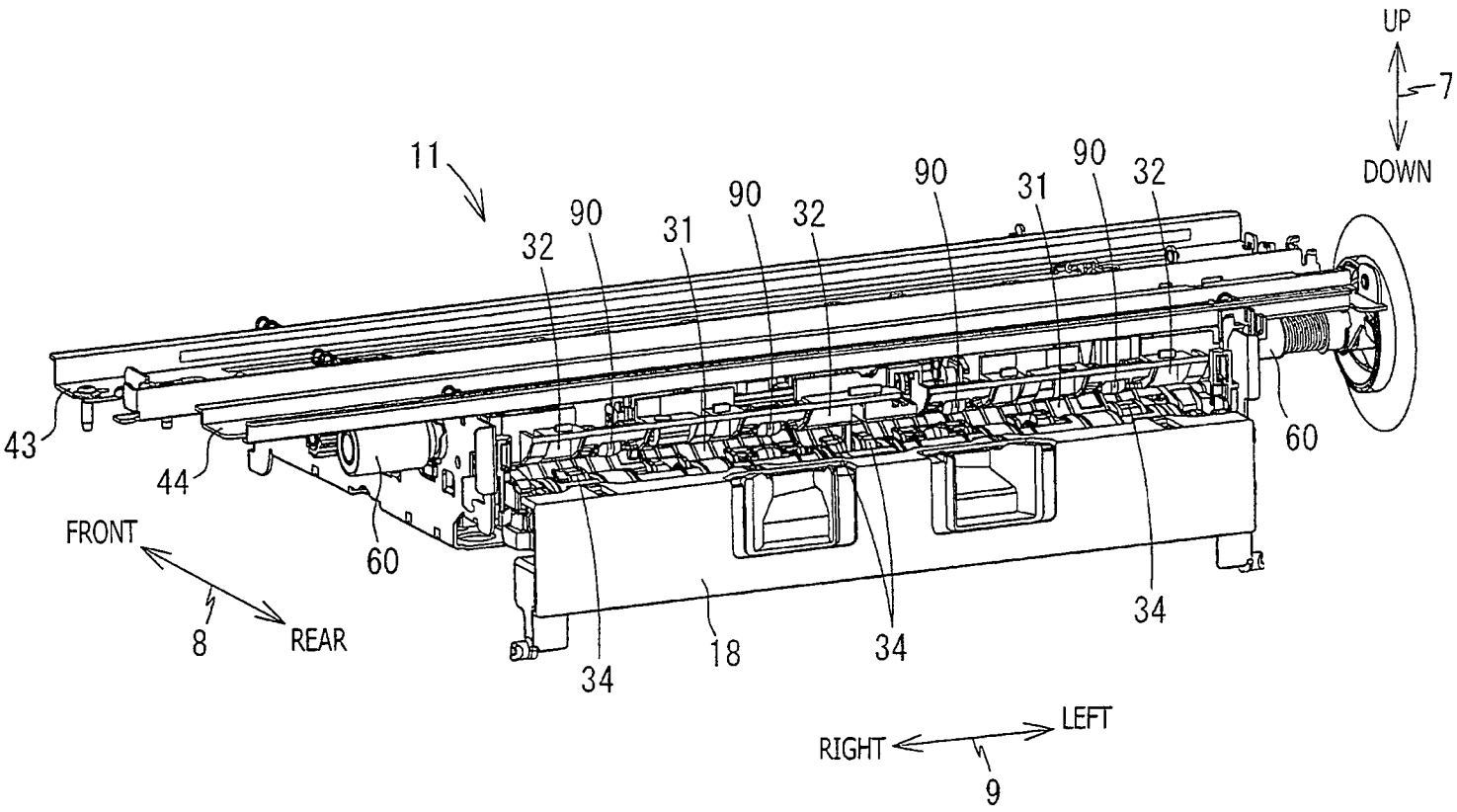
FIG. 3 is a perspective view showing an outer guide member and components therearound of the printer unit of the MFP according to the illustrative embodiment of the disclosures.

As shown in FIGS. 2, 5A and 5B, the first upper guide member 32 rotatably supports a guide roller 90. The guide roller 90 is arranged above the connection position 80. A part of a roller surface (i.e., the circumferential surface) of the guide roller 90 is formed to protrude toward the conveying passage 65 and the bypass passage 66. That is, the guide roller 90 is configured to have a portion which protrudes toward the connection position 80. As shown in FIG. 3, there are multiple guide rollers 90, which are arranged in the right-left direction 9 at certain intervals.

Figure 8:
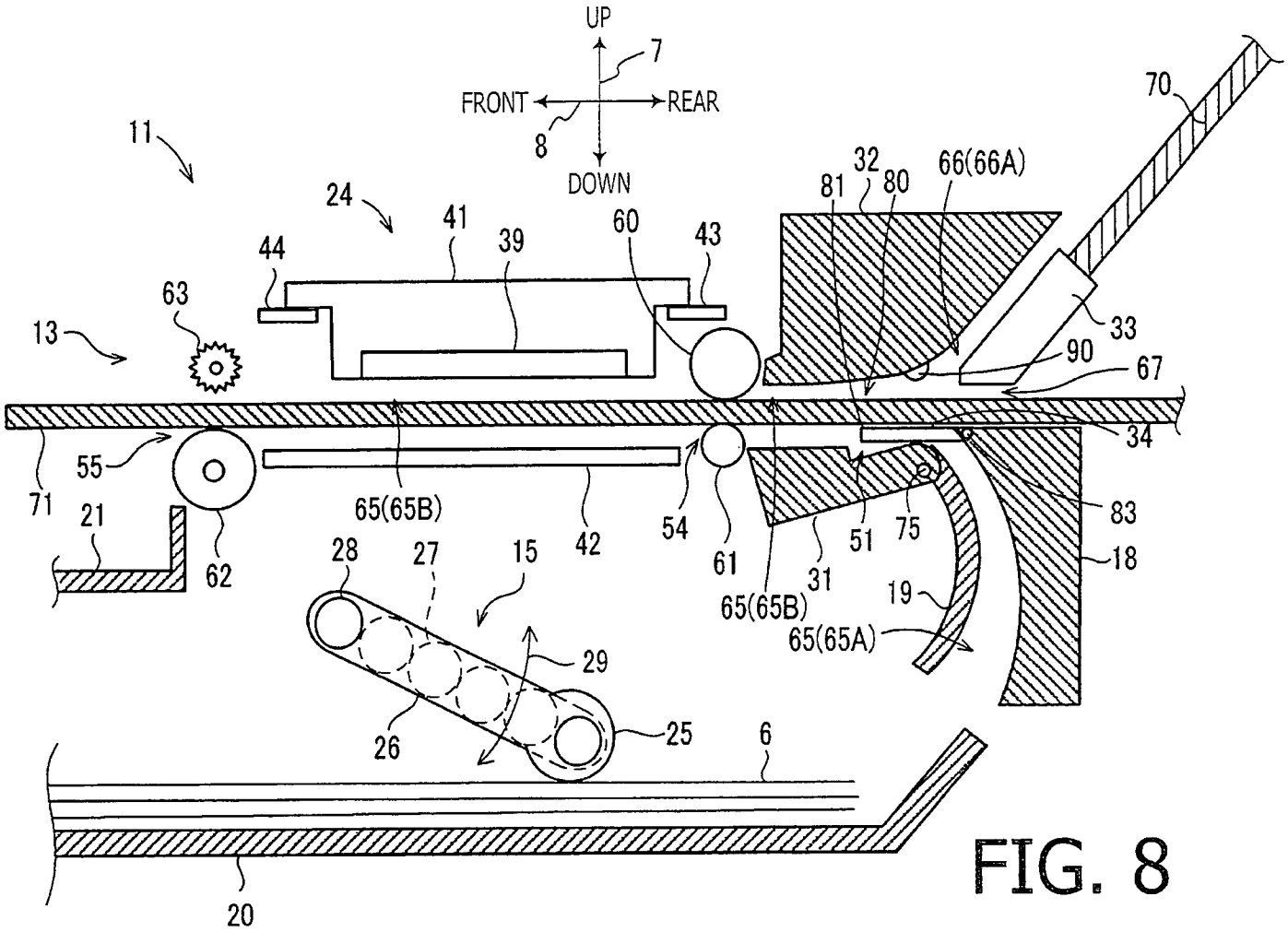
FIG. 8 is a cross-sectional view schematically showing the inner structure of the printer unit of the MFP, according to the illustrative embodiment of the disclosures, in a state where a sheet tray is inserted.

As shown in FIG. 8, the lower end of the guide roller 90 is located at a higher position with respect to the medium tray 71 conveyed along the label print passage 67 and the linear passage 65B. In other words, the lower end of the guide roller 90 is located at a higher position with respect to the medium tray 71 which is supported and conveyed by the first conveying roller 60 and the second conveying roller 62. That is, the guide roller 90 is arranged at a position where the guide roller 90 does not contact the medium tray 71 passing through the label print passage 67.

<Flap 34>

Figure 7A:
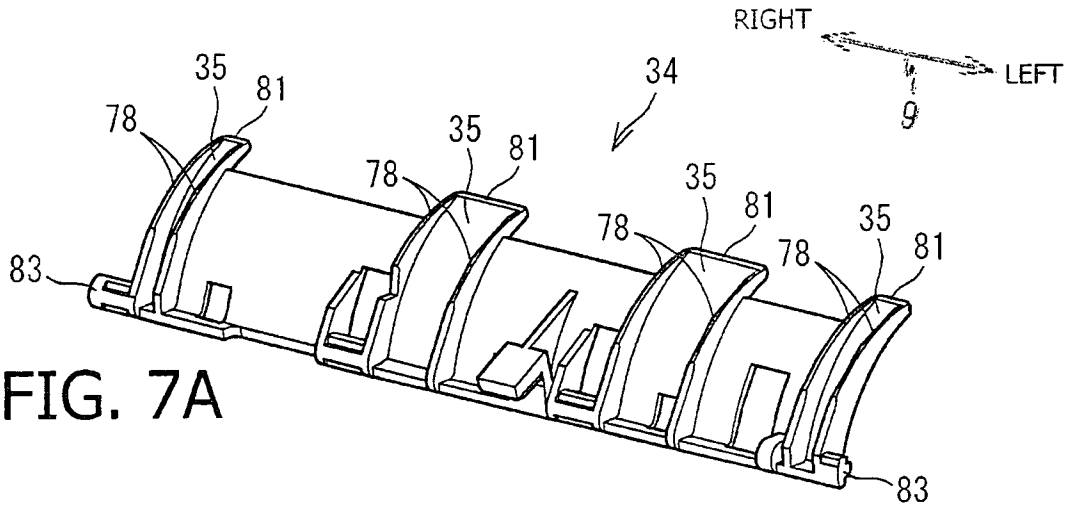
FIGS. 7A and 7B are perspective views showing appearances of both sides of the flap according to the illustrative embodiment.
Figure 7B:
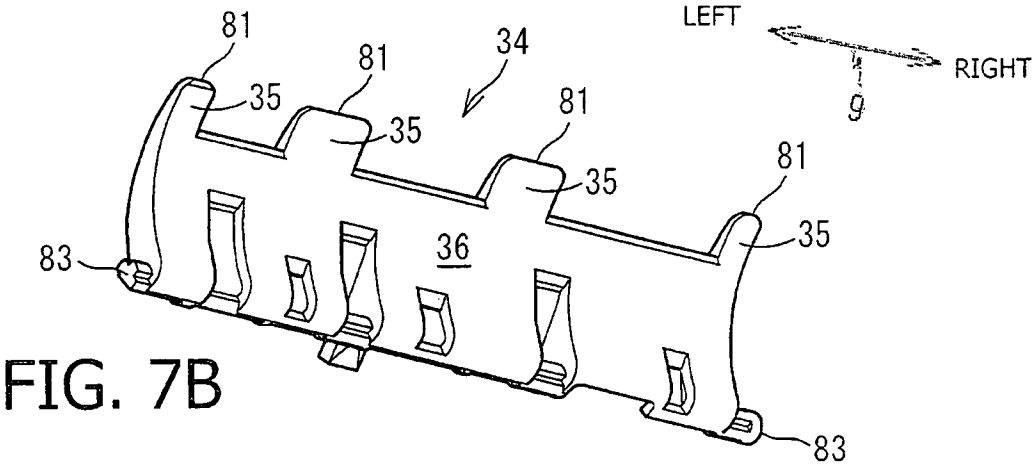

As shown in FIG. 2, the flap 34 is provided at the curved passage 65A. The flap 34 has a curved plate shape as shown in FIG. 7A or FIG. 7B. It is noted that multiple flaps 34 may be arranged in the right-left direction 9 at intervals.

As shown in FIG. 2, the flap 34 is rotatably supported by the outer guide member 18. Specifically, shafts 83 (see FIGS. 7A and 7B) provided on right and left ends of a rear part of the flap 34 are rotatably supported by the outer guide member 18.

The flap 34 is configured such that upstream and downstream sides, in the conveying direction 17, thereof are proximal and distal ends (i.e., movable ends) thereof, and is configured to be rotatable between a first position shown in FIG. 2 by solid line and shown in FIG. 5A, and a second position shown in FIG. 2 by a broken line and shown in FIG. 6.

The flap 34 is located below the connection position 80 when located at the first position. Further, the flap 34 is located below the label print passage 67 when located at the first position.

As shown in FIGS. 7A and 7B, on a back side of the guide surface 36 which is the under surface of the flap 34, multiple ribs 78 are provided at intervals in the right-left direction 9. When the flap 34 is located at the first position, the ribs 78 define a part of the underside of the linear passage 65B together with the lower guide member 31.

Further, the flap 34 has multiple protruded parts 35 which are protruded from a downstream side, in the conveying direction 17. Tip ends of the protruded parts 35 constitute a distal end (i.e., a movable end) 81 of the flap 34. When the flap 34 is located at the first position, the protruded parts 35 are accommodated in the concave parts 51 formed on the lower guide member 31, respectively. It is noted that the protruded parts 35 may be completely accommodated by the concave parts 51, respectively. Alternatively, the protruded parts 35 may be accommodated in the concave parts 51 with their upper portions being protruded from the concave parts 51, respectively.

As shown in FIG. 2, the flap 34 is kept stayed at the first position by its own weight when an external force is not applied to the flap 34. Thus, the protruded parts 35 contact bottom surfaces of the concave parts 51 of the lower guide member 31 from the above, and the protruded parts 35 are in a state to be supported by the bottom surfaces of the concave parts 51. As a result, the flap 34 is kept stayed at the first position.

It is noted that the lower guide member 31 may not be formed with the concave parts 51. In such a case, the flap 34 at the first position simply contact the lower guide member 31 from the above and is brought in state of being supported by the lower guide member 31. Alternatively, the protruded parts 35 of the flap 34 may be supported by a member other than the lower guide member 31 (e.g., by the casing 14).

As described above, the flap 34 at the first position is supported such that the proximal end thereof is supported by the outer guide member 18, and the protruded parts 35 located on the movable end (i.e., distal end) are supported by the lower guide member 31. With this configuration, the flap 34 at the first position blocks passage from the curved passage 65A to the connection position 80. Thus, the flap 34 at the first position is spaced from the first upper guide member 32. As a result, the label print passage 67 and the bypass passage 66 are opened with respect to the connection position 80. In other words, the flap 34 does not block passage through the label print passage 67 or the bypass passage 66 when located at the first position 34.

It is noted that the flap 34 at the first position needs not completely block passage from the curved passage 65A to the connection position 80. For example, the flap 34 at the first position may partially block passage from the curved passage 65A to the connection point 80 on condition that the printing sheet 6 conveyed through the curved passage 66A can be prevented from entering the curved passage 65A.

As described in detail later, the flap 34 is pushed by the printing sheet 6 conveyed through the curved passage 65A in the conveying direction 17 and moves from the first position to the second position. As shown in FIGS. 6A and 6B, when the flap 34 is located at the second position, substantially a central part, in the front-rear direction 9, of the flap 34 is located at the connection position 80.

As shown in FIGS. 6A and 6B, when the flap 34 moves from the first position to the second position, the movable end 81 of the flap 34 moves away from the lower guide ember 31. As a result, the curved passage 65A is opened toward the connection position 80. Further, as the flap 34 rotates from the first position to the second position, the movable end 81 of the flap 34 contacts the under surface of the first upper guide member 32.

According to the illustrative embodiment, the movable end 81 of the flap 34 at the second position contacts the first upper guide member 32 on the downstream side, in the conveying direction 17, with respect to the connection position 80. In other words, the movable end 81 of the flap 34 at the second position contacts the first upper guide member 32 on the first conveying roller 60 side with respect to the connection point 80. Thus, the flap 34 blocks passage from the label print passage 67 and the bypass passage 66 to the connection position 80. According to the illustrative embodiment, a concave part (not shown) is formed on the first upper guide member 32, and the movable end 81 of the flap 34 enters the concave part when the flap 34 is located at the second position.

It is noted that the flap 34 at the second position needs not completely block passage from the label print passage 67 and the bypass passage 66 to the connection point 80. For example, the flap 34 at the second position may partially blocks passage through the label print passage 67 and the bypass passage 66 on condition that the printing sheet 6 conveyed through the curved passage 65A is prevented from entering the bypass passage 65 and the label print passage 67.

It is noted that a partial blocking of passage from the curved passage 65A, the label print passage 67 or the bypass passage 66 to the connection position 80 includes a condition where, when there are multiple flaps 34 which are arranged in the right-left direction 9 at intervals, the portions corresponding to the intervals do not block the corresponding passage.

As shown in FIGS. 6A and 6B, when the flap 34 is located at the second position, the guide surface 36, which is the under surface of the flap 34, constitutes the curved outside part of the curved passage 65A. Further, when the flap 34 is located at the second position, the roller conveyer 37 rotatably supported by the lower guide member 31 constitute the curved inside part of the curved passage 65A at a position facing the guide surface 46.

Further, when the flap 34 is located at the second position, the guide roller 90 is arranged at the opposite position with respect to the flap 34. In other words, the guide surface 36, which constitutes the curved passage 65A when the flap 34 is located at the second position, is located at a position closer to the inner guide member 19 and the lower guide member 31 than the guide roller 90. That is, when the flap 34 is located at the second position, the guide surface 36 facing the curved inside part of the curved passage 65A is located at an inner side of the curved inside part than the guide roller 90.

<Image Recordation on Printing Sheet 6>

When the user operates an operation panel 73 (see FIG. 1) provided at an upper part of the front surface of the MFP 10, and a controller (not shown) of the MFP 10 instructs image recordation on the printing sheet 6 supported on the sheet feed tray 20, the sheet feed roller 25 is rotated. Then, the printing sheet 6 supported on the sheet feed tray 20 is fed to the curved passage 65A, and conveyed through the curved passage 65A in the conveying direction.

As shown in FIGS. 5A and 5B, in a neutral state, the flap 34 is kept located at the first position. When the leading end, in the conveying direction 17, of the printing sheet 6 contacts the flap 34 located at the first position, the flap 34 is pushed by the printing sheet 6 and rotates from the first position to the second position. Then, as shown in FIGS. 6A and 6B, the flap 34 is separated from the lower guide member 31.

Thus, the curved passage 65A and the liner passage 65B which were blocked by the flap 34 are connected. Then, the printing sheet 6 is guided by the guide surface 36 and conveyed from the curved passage 65A to the linear passage 65B. At this time, contact of the printing sheet 6 to the guide roller 90, and entrance of the printing sheet 6 from the conveying passage 65 to the bypass passage 66 or the label print passage 67 are prevented by the flap 34 which is now located at the second position. It is noted that, when the trailing end, in the conveying direction 17, is moved away from the flap 34, the flap 34 rotates back from the second position to the first position by its own weight. In other words, the flap 34 rotates in a direction indicated by arrow 91 by its own weight. The direction of the arrow 91 is a direction in which the protruded parts 35 move downward.

Thereafter, the printing sheet 6 passes below the recording unit 24. At this stage, ink drops are ejected from the recording head 39 of the recording unit 24 to the printing sheet 6, and images are recorded on the printing sheet 6. Thereafter, the printing sheet 6 is discharged from the opening 13 to the outside of the MFP 10, and stacked on the discharged sheet tray 21.

When the user operates the operation panel 73, and the controller of the MFP 10 instructs image recordation on the printing sheet 6 supported by the bypass tray 70, the first conveying roller 60 rotates. At this stage, as described above, the printing sheet 6 has been guided by the guide roller 90 and flap 34 (i.e., the ribs 78 of the flap 34), and inserted in the casing 14. The printing sheet 6 is now supported by the bypass tray 70, and the leading end of the printing sheet 6 is currently nipped by the first conveying roller pair 54.

When the first conveying roller 60 rotates, the printing sheet 6 supported on the bypass tray 70 is conveyed by the first conveying roller pair 54. At this time, the printing sheet 6 is smoothly conveyed by the guide roller 90. Further, at this time, the conveyed printing sheet 6 is prevented from entering the curved passage 65A as blocked by the flap 34 which is located at the first position. Thereafter, similarly to the above, an image is recorded on the conveyed printing sheet 6 by the recording unit 24, and the printing sheet 6 is discharged through the opening 13 and stacked on the discharged sheet tray 21.

<Image Recordation on Recording Medium Supported by Medium Tray 71>

When an image is recorded on the recording medium supported by the medium tray 71, firstly the user operates the lever part 95 to move forward. Then, the conveying roller pairs 54 and 55, the platen 42, and the lower guide member 31 move to downward positions and the second rotation position, respectively. Next, by the user, the medium tray 71 supporting the recording medium is inserted in the MFP 10 with being supported by a tray guide (not shown) provided inside the inner space communicating with the opening 13. At this stage, the leading end of the medium tray 71 is located on the rear side with respect to the first conveying roller 60.

In this state, when the user operates the operation panel 73 and the controller of the MFP 10 instructs recordation of an image on the recording medium, the first conveying roller 60 and the second conveying roller 62 are forwardly rotated. Then, the medium tray 71 is conveyed rearward (i.e., a direction opposite to the conveying direction 17) and reaches the label print passage 67 through the linear passage 65B. That is, the medium tray 71 is inserted from a most downstream side, in the conveying direction 17, and conveyed to reach the label print passage 67. It is noted that the medium tray 71 is conveyed rearward until the surface of the recording medium mounted on the medium tray 71 faces the recording unit 24.

It is noted that, since the flap 34 at the first position is located below the label print passage 67, the medium tray 71 being conveyed does not contact the flap 34. Further, since the guide roller 90 is arranged at a higher position with respect to the medium tray 71 which is conveyed through the label print passage 67 and the linear passage 65, the medium tray 71 being conveyed does not contact the guide roller 90.

Next, under control by the controller, rotation of the first conveying roller 60 and the second conveying roller 62 are switched from the forward rotation to the reverse rotation. By this switching of the rotation direction, the medium tray 71 is conveyed forwardly. At this stage, the recording head 39 ejects ink drops to form an image on the surface of the recording medium mounted on the medium tray 71. Thereafter, the medium tray 71 is discharged from the MFP 10 through the opening 13.

It is noted that, in a state where the medium tray 71 has been conveyed rearward and reached the label print passage 67, the medium tray 71 may be protruded from the rear surface of the MFP 10 through an opening (not shown) formed on the rear surface of the MFP 10, or may not be protruded. It is noted that, when the medium tray 71 is not protruded from the rear surface of the MFP 10, the opening (not shown) explained above may not be formed.

Further, according to the illustrative embodiment, the medium tray 71 is inserted from the front side of the MFP 10. This configuration may be modified such that the medium tray 71 is inserted in the MFP 10 from the rear side thereof.

Effects of Illustrative Embodiment

According to the illustrative embodiment, the conveying passage 65 is blocked at the connection position 80 and the bypass passage 66 is opened when the flap 34 is located at the first position. Accordingly, the printing sheet 6 could be conveyed from the bypass tray 70 to the first conveying roller 60 through the bypass passage 66. The printing sheet 6 contacts the guide roller 90 located at the curved inside part of the curved passage 66A at the connection position 80, the printing sheet 6 can be conveyed smoothly.

Further, the conveying passage 65 is opened and the bypass passage 66 is blocked at the connection position by the flap 34 located at the second position. Accordingly, the printing sheet 6 could be conveyed from the sheet feed tray 20 to the first conveying roller 60 through the conveying passage 65. At the connection position 80, the guide surface 36 of the flap 34 at the second position guides the printing sheet 6 at the curved inside part with respect to the guide roller 90 which is located at the curvature outside of the curved passage 65A, the printing sheet 6 being conveyed though the conveying passage 65 is prevented from contacting the guide roller 6.

According to the illustrative embodiment, the movable end 81 of the flap 34 located at the second position contacts the first upper guide member 32 on the first conveying roller 60 side with respect to the connection position 80, the bypass passage 66 is securely blocked at the connection position 80.

Further, according to the illustrative embodiment, the medium tray 71 can be conveyed linearly by the linear passage 65B and the label print passage 67 of the conveying passage 65.

Further, according to the illustrative embodiment, since the guide roller 90 is arranged at a higher position than the medium tray 71 which is conveyed through the label print passage 67 and the linear passage 65B, the guide roller 90 does not interfere with the medium tray 71 passing through the label print passage 67.

Furthermore, according to the illustrative embodiment, since the printer unit 11 has the recording unit 24, image can be recorded on the printing sheet 6 and/or the recording medium such as a CD-ROM conveyed through respective conveying passages.

Modification

Figures 9A, 9B:
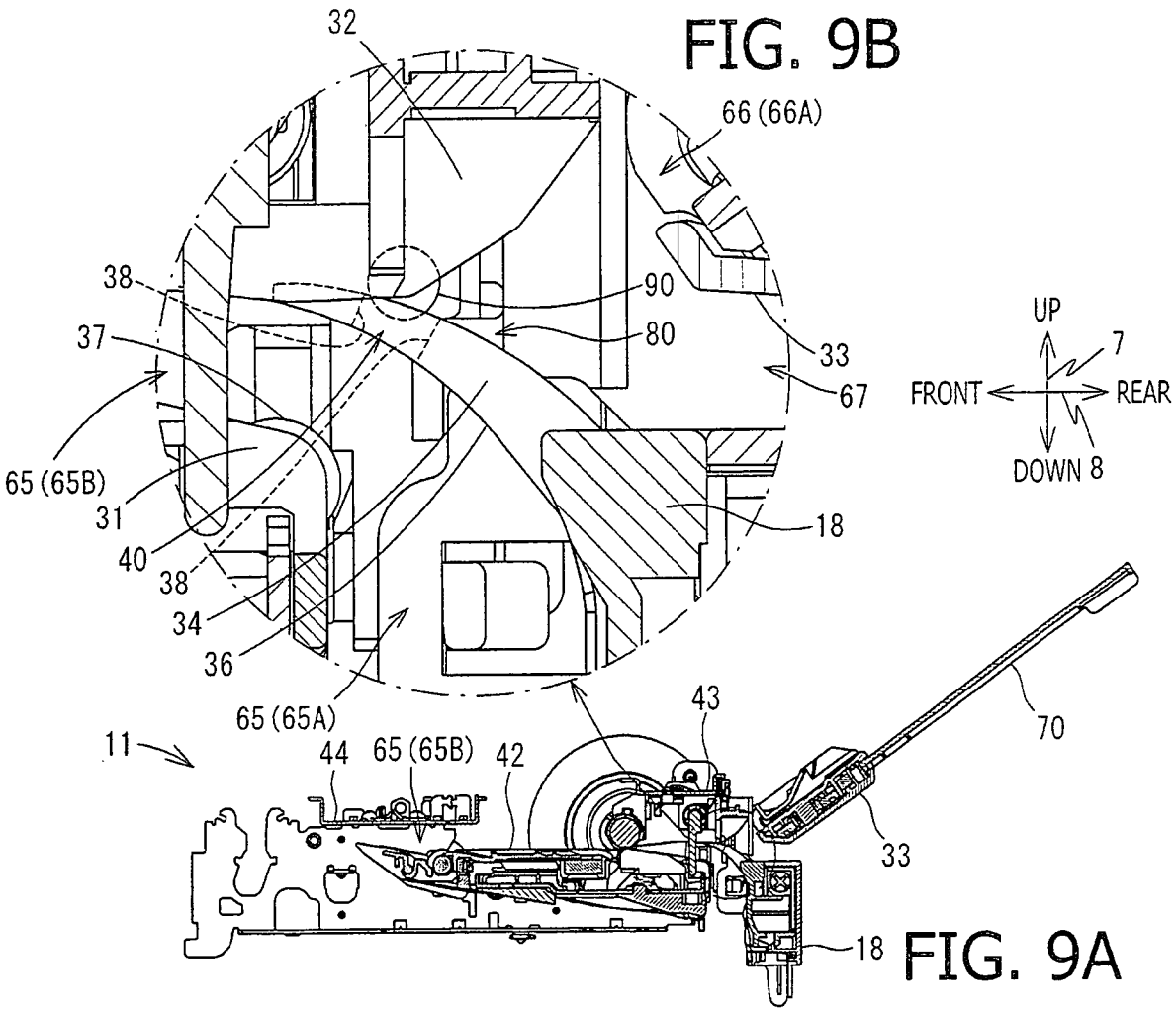
FIG. 9A is a cross-sectional view of the flap formed with an opening and components therearound according to the illustrative embodiment of the disclosures.
FIG. 9B is an enlarged view of a part of FIG. 9A encircled by a slid line.

According to the illustrative embodiment described above, when the flap 34 is located at the second position, the guide roller 90 is arranged on the opposite side to the roller conveyer 37 with respect to the flap 34. It is noted that what is necessary is that the guide roller 90 is arranged on the opposite side to the roller conveyer 37 with respect to the guide surface 36 of the flap 34. For example, as shown in FIGS. 9A and 9B, an opening part 38 may be formed at a position on the flap 34 corresponding to the guide roller 90, and the guide roller 90 may enter a space 40 defined by the opening part 38.

According to the above modification, degree of freedom in layout can be enhanced with suppressing interference between the flap 34 and the guide roller 90.

Figure 10:
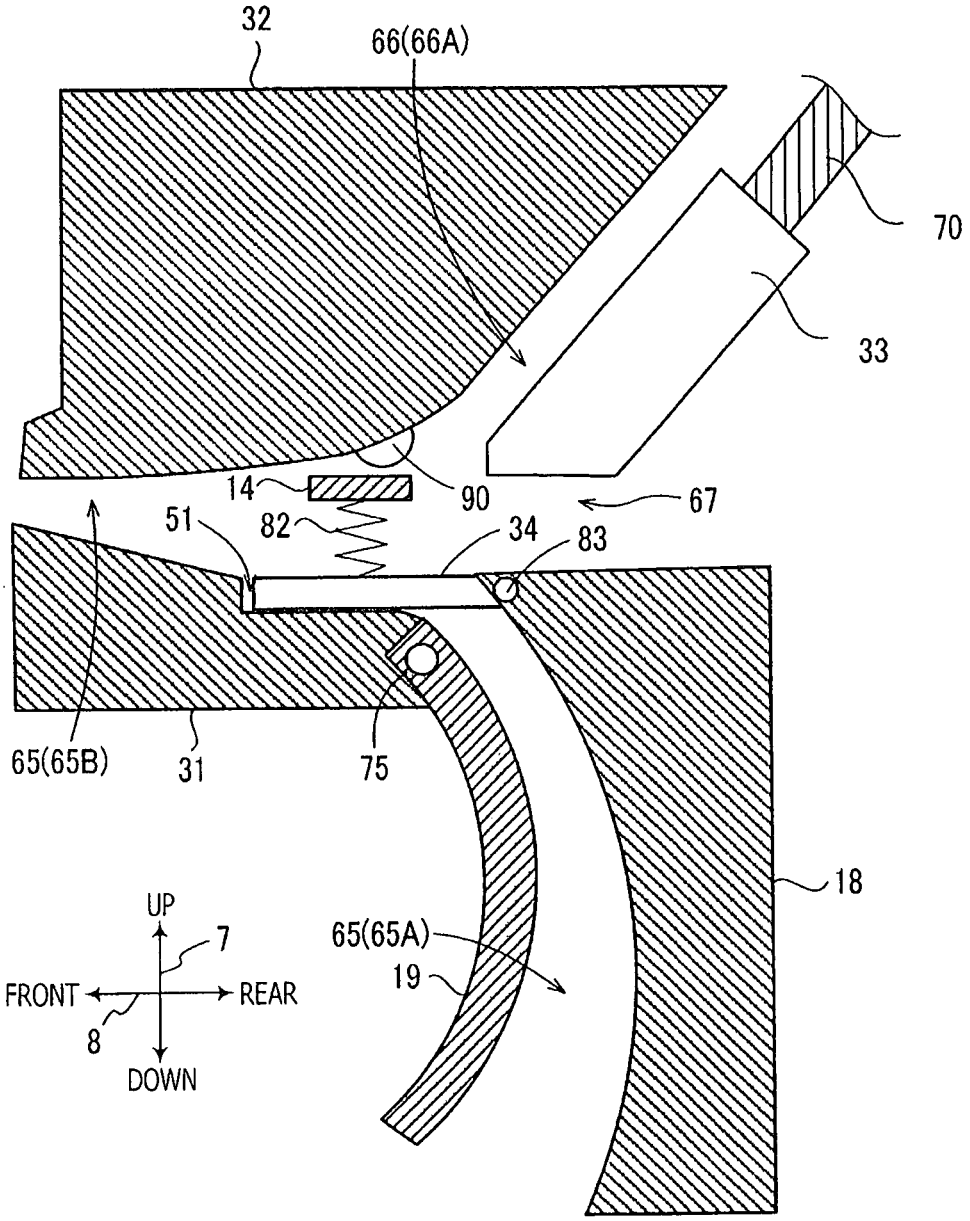
FIG. 10 is a cross-sectional view of the flap provided with a coil spring and components therearound according to the illustrative embodiment of the disclosures.

According to the illustrative embodiment, the flap 34 stays at the first position by its own weight in a neutral state. This configuration may be modified such that the flap 34 is urged toward the first position by an urging member, thereby staying at the first position. For example, the urging member may be a coil spring 82 shown in FIG. 10. The coil spring 82 may be arranged on an outer side with respect to the conveying passage 65 in the right-left direction 9. Further, an end of the coil spring 82 may be attached to the flap 34, while the other end is attached to the casing 14 at a higher position than the one end of the coil spring 82. It is noted that the urging member needs not be limited to the coil spring 82, but can be any member which is configured to urge the flap 34 toward the first position.

According to the modification described above, in a state where the printing sheet 6 is not being conveyed from the sheet feed tray 20, the flap 34 can be securely maintained to stay at the first position.

According to the illustrative embodiment, the printing sheet 6 is supported by the bypass tray 70 with its leading end contacting the first conveying roller pair 54. It is noted the printing sheet 6 may be supported by the bypass tray 70 with its leading end not contacting the first conveying roller pair 54. In this case, the printer unit 11 may have a roller (not shown) which contacts the printing sheet 6 supported by the bypass tray 70 from a side opposite to the bypass tray 70. When such a roller rotates, the printing sheet 6 supported on the bypass tray 70 can be conveyed to the conveying passage 65 through the bypass passage 66. It is noted that the printing sheet 6 conveyed from the bypass tray 70 is conveyed smoothly as it contact the guide roller 90.

According to the illustrative embodiment, the printer unit 11 is an example of a sheet conveyer set forth in the claims. The sheet conveyer is configured to convey the printing sheet 6 on which an image is to be printed by the recording unit 24. It should be noted that the sheet conveyer needs not be limited to the printer unit 11. For example, the sheet unit may be a scanner unit 12. In this case, the sheet conveyer is interpreted to convey an original sheet, and the scanner unit 12 is configured to scan an image of the original sheet conveyed by the sheet conveyer.

What is claimed is:

1. A sheet conveyer, comprising:

a casing in which a first conveying passage and a second conveying passage are defined, the first conveying passage extending from a first tray and having a first curved passage which is curved in a particular direction, the second conveying passage extending from a second tray and having a second curved passage, which curves in a direction opposite to the first curved passage, and connected to the first conveying passage at a connection position;

a conveying roller configured to convey a sheet and arranged in the first conveying passage at a position opposite to the first tray with respect to the connection position;

a first guide member arranged above the connection position and constituting a curved outside part of the first curved passage and a curved inside part of the second curved passage, the second curved passage including a portion where the first guide member faces a first upper guide member;

a second guide member constituting a curved outside part of the first curved passage, in the first conveying passage, on a first tray side with respect to the first guide member;

a third guide member constituting a curved inside part of the first curved passage;

a guide roller provided to the first guide member and protruded toward a position close to the connection position wherein the Guide roller is downstream of the portion of the second curved passage where the first guide member faces the first upper guide member;

a flap rotatably provided to the second guide member, wherein the flap is maintained at a first position in a neutral state, the flap blocks passage from at least a part of the first conveying passage to the connection position and the second conveying passage is opened to the connection position when the flap is located at the first position, wherein the flap moves to a second position as the flap contacts the sheet conveyed through the first conveying passage, the first conveying passage being opened toward the connection position and at least a part of the second conveying passage is blocked with respect to the connection position, a rotatable end of the flap being located on the conveying roller side with respect to the guide roller when the flap is located at the second position, and wherein a lower surface of the flap is located at a position closer to the third guide member than the guide roller when the flap is located at the second position.

2. The sheet conveyer according to claim 1, wherein the rotatable end of the flap is configured to contact the first guide member on the conveying roller side with respect to the connection position when the flap is located at the second position.

3. The sheet conveyer according to claim 1, wherein the flap has an opening part, and wherein the guide roller enters a space defined by the opening of the flap located on the second position.

4. The sheet conveyer according to claim 1, wherein the first conveying passage has a linear passage which linearly extending from the connection position toward the conveying roller, wherein the casing further having a third conveying passage which extends linearly from the connection position toward a direction opposite to the linear passage and allows conveyed medium to pass through without bending the conveyed medium, and wherein the flap does not block passage from the third conveying passage when located at the first position, while blocks passage from at least a part of the third conveying passage to the connection position when located at the second position.

5. The sheet conveyer according to claim 4, wherein the guide roller is arranged not to contact the conveyed medium passing through the third conveying passage.

6. The sheet conveyer according to claim 4, further comprising a recording unit which is arranged along the first conveying passage and at a position opposite to the first tray with respect to the conveying roller and configured to record an image on a sheet or a recording medium conveyed through the first conveying passage.

7. The sheet conveyer according to claim 6, wherein the conveyed medium comprises a medium tray configured to support the recording medium.

8. The sheet conveyer according to claim 7, wherein the medium tray is inserted from the linear passage of the first conveying passage and reaches the third conveying passage.

9. The sheet conveyer according to claim 1, further comprising an urging member which urges the flap toward a first side.

10. The sheet conveyer according to claim 1, wherein a movable end of the flap is maintained to contact the third guide member.

11. A sheet conveyer, comprising:

a casing in which a first conveying passage and a second conveying passage are defined, the first conveying passage extending from a first tray and having a first curved passage which is curved in a particular direction, the second conveying passage extending from a second tray and having a second curved passage, which curves in a direction opposite to the first curved passage, and connected to the first conveying passage at a connection position;

a conveying roller configured to convey a sheet and arranged in the first conveying passage at a position opposite to the first tray with respect to the connection position;

a first guide member arranged above the connection position and constituting a curved outside part of the first curved passage and a curved inside part of the second curved passage;

a second guide member constituting a curved outside part of the first curved passage, in the first conveying passage, on a first tray side with respect to the first guide member;

a third guide member constituting a curved inside part of the first curved passage;

a guide roller provided to the first guide member and protruded toward a position close to the connection position;

a flap rotatably provided to the second guide member, wherein the flap has an opening part, wherein the flap is maintained at a first position in a neutral state, the flap blocks passage from at least a part of the first conveying passage to the connection position and the second conveying passage is opened to the connection position when the flap is located at the first position, wherein the flap moves to a second position as the flap contacts the sheet conveyed through the first conveying passage, the first conveying passage being opened toward the connection position and at least a part of the second conveying passage is blocked with respect to the connection position, wherein a lower surface of the flap is located at a position closer to the third guide member than the guide roller when the flap is located at the second position, and wherein the guide roller enters a space defined by the opening of the flap located on the second position.

* * * * *